United States Patent [19]

Büchler et al.

[11] Patent Number: 4,970,773

[45] Date of Patent: Nov. 20, 1990

[54] METHOD OF AND APPARATUS FOR LOCATING OPERATIONAL SURFACES ON A TRACK ELECTROMAGNETICALLY LEVITATED VEHICLES

[75] Inventors: Wilhelm Büchler, Haar; Karl-Heinz Lönnecke, Bremen-Lesum; Herbert Schambeck, Frieding, all of Fed. Rep. of Germany

[73] Assignee: Dyckerhoff & Widmann Aktiengesellschaft, Munich, Fed. Rep. of Germany

[21] Appl. No.: 387,028

[22] Filed: Jul. 27, 1989

[30] Foreign Application Priority Data

Jul. 27, 1988 [DE] Fed. Rep. of Germany ..... 3825508

[51] Int. Cl.[5] ..... B21D 39/00

[52] U.S. Cl. ..... 29/407; 29/452; 29/460; 29/467; 29/525.1; 29/559; 29/281.4; 29/281.5; 29/281.6; 104/286; 249/23; 249/86; 264/261

[58] Field of Search ..... 29/460, 452, 459, 467, 29/525.1, 281.4, 281.5, 291.6, 407; 104/286; 264/261, 263, 333; 249/86, 83, 23

[56] References Cited

U.S. PATENT DOCUMENTS

| | | | |
|---|---|---|---|
| 3,103,062 | 9/1963 | Himmelberge | 29/281.6 X |
| 3,341,639 | 9/1967 | Nwillon | 264/261 X |
| 3,791,309 | 2/1974 | Baermann | 104/286 X |
| 3,848,034 | 11/1974 | Schaefer | 264/263 X |
| 3,908,975 | 9/1975 | Bryant | 29/281.5 X |
| 4,064,808 | 12/1977 | Nauamnn et al. | 104/286 |
| 4,411,054 | 10/1983 | Zeilenga | 29/281.6 X |
| 4,564,994 | 1/1986 | Marx | 29/281.5 X |
| 4,616,395 | 10/1986 | Farese et al. | 29/460 |
| 4,626,299 | 12/1986 | Knight et al. | 29/460 X |

FOREIGN PATENT DOCUMENTS 3139636 4/1983 Fed. Rep. of Germany .

*Primary Examiner*—Timothy V. Eley

*Attorney, Agent, or Firm*—Toren, McGeady & Associates

[57] ABSTRACT

On a track for electromagnetically levitated vehicles, to adjust and secure side guide rails on a beam-like support member forming the track, after stators are adjusted and fixed to the support member, the side guide rails are held in position relative to the support member. Initially, the guide rails are positioned relative to the track and then are adjusted with respect to a datum plane determined by the lower surfaces of the stators. Next, the guide rails are adjusted horizontally transversely of the track with respect to measuring points fixed to the surface of the support member. Finally, the guide rails are attached to the support member. Apparatus for installing the guide rails includes a plurality of installation truss frames mounting assembly arms for holding the guide rails. Each assembly arm has a holding device for a guide rail and an abutment positionable against a lower surface of the stators. The installation truss frames are supported on a transport frame so that the truss frames can be moved laterally relative to the support member and adjusted in height with respect to the upper surface of the support member. Each installation truss frame supports a measuring device with a measuring head to be brought into coincidence with a measuring point located on the upper surface of the support member.

28 Claims, 11 Drawing Sheets

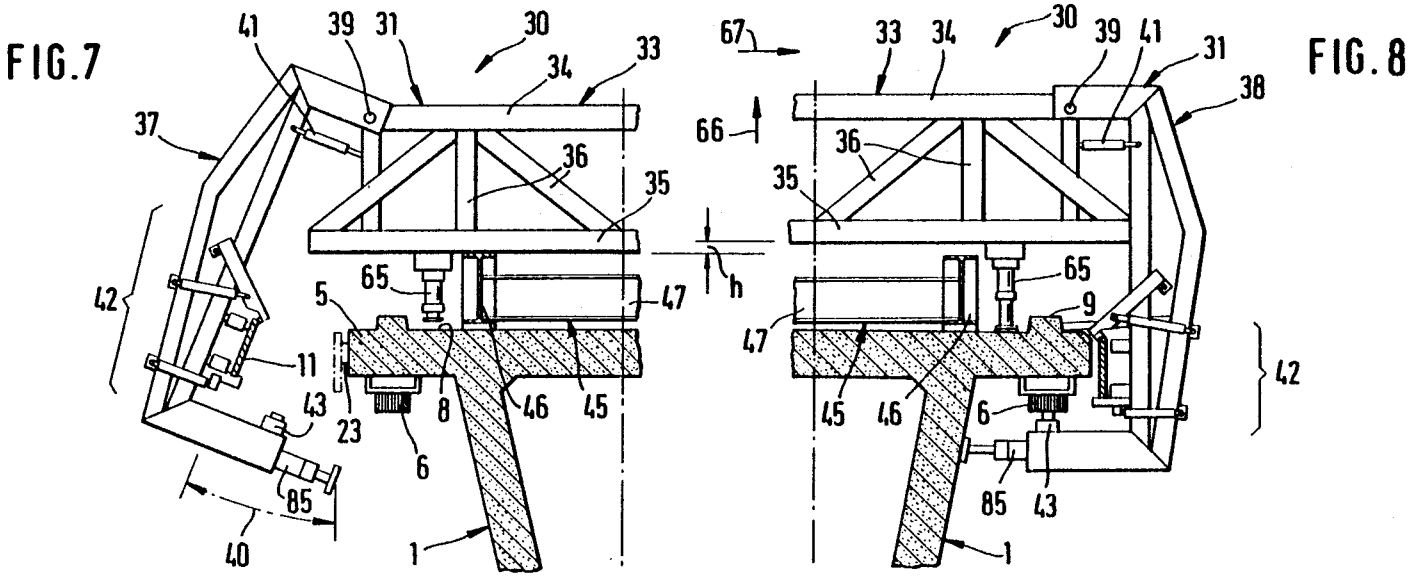
FIG. 8
FIG. 7
30
31
33
34
35
36
37
38
39
40
41
42
43
45
46
47
5
6
8
9
11
23
65
66
67
85
1
h
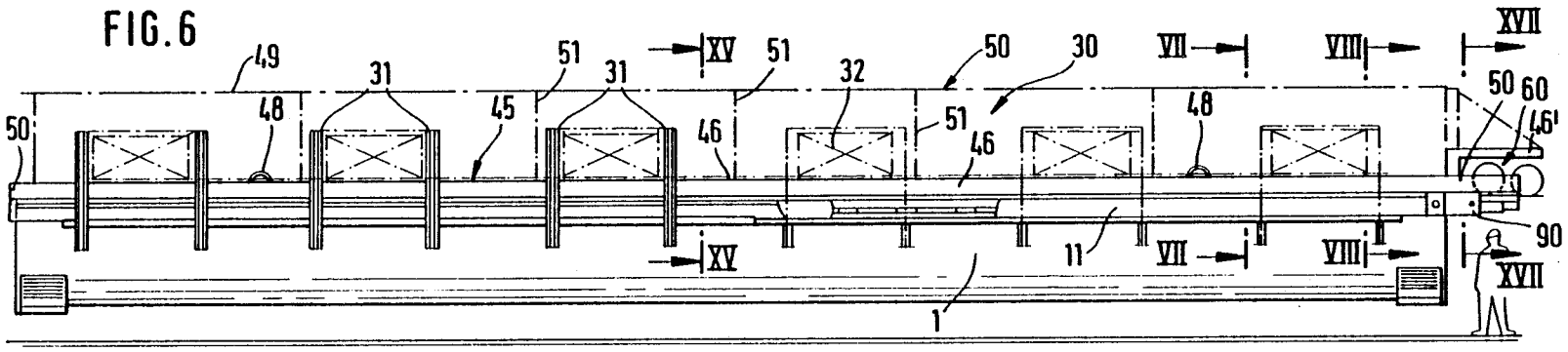
FIG. 6
XVII
VIII
VII
XV
30
31
32
45
46
46'
48
49
50
51
60
90
11
1

METHOD OF AND APPARATUS FOR LOCATING OPERATIONAL SURFACES ON A TRACK ELECTROMAGNETICALLY LEVITATED VEHICLES

CROSS REFERENCE TO RELATED APPLICATIONS

The present application is an improvement with regard to application Ser. No. 194,383, now U.S. Pat. No. 4,854,028, filed May 16, 1988 and application Ser. No. 354,504, now U.S. Pat. No. 4,909,474, filed May 9, 1989, which is a division of the earlier filed application.

BACKGROUND OF THE INVENTION

The present invention is directed to a method of and apparatus for the adjustment and attachment of operational surfaces on a track for electromagnetically levitated vehicles. The track is a beam-like support member formed of steel, reinforced concrete or prestressed concrete. The support member has a deck slab mounted on a box-like girder member, with parts of the deck slab cantilevered outwardly on both sides of the girder member. The operational surfaces include stators located on the underside of the cantilevered parts, and slide guide rails extending on and secured to the outer sides of the cantilevered parts.

A known track for a high speed railroad using electromagnetically levitated vehicles includes track supports in the form of single span beams constructed from prestressed concrete and located on elevated piers. Operational elements for the electromagnetic levitation technology are located on the track supports and the elements provide the operational surfaces required for the support, guidance, drive, and braking, as well as for data transmission from the control center and current supply to the vehicle. Note the German magazine "BAUINGENIEUR" (Civil Engineer) 1983, pages 129 to 134. In this known track, the track support has a closed, approximately trapezoidally-shaped cross-section with an upper deck plate cantilevered outwardly on both sides from support webs of the closed cross-section. Operational elements for the levitating vehicles are located in the region of the cantilevered parts, that is, support stators from electroplates and cable windings fixed between the cantilevered parts, rails for side guidance of the vehicles and for the transmission of braking forces fixed on the outer sides of the cantilevered parts, as well as slide surfaces located along the upper surface of the deck slab of the support members, with the side surfaces supporting the vehicles when they come to rest during stoppage and during possible malfunction of the electromagnetic system.

These operational elements have operational surfaces which must be positioned with great accuracy in view of the high speeds of the levitating vehicles. Accordingly, where track supports of reinforced prestressed concrete are used, the tolerances usually present in concrete construction must be compensated. An apparatus is known for avoiding the individual installation and adjustment of operational elements which is very time and work consuming, and in which the elements can be installed and adjusted in one working operation. Note DE-OS 31 39 636. The essential feature of the apparatus involves different machining or processing devices located on a single machine frame so that the machine frame can travel on the track supports and can be fixed to the track supports for performing individual machining steps with the machining devices being adjustable with reference to external check or datum points by means of surveying technology equipment for providing accurate positioning of the operating elements. Because of the tolerances in concrete track supports which cannot be avoided in construction operations and due to the tolerances in surveying operations which cannot be completely eliminated, even when the greatest care is exercised, this known apparatus has deficiencies or disadvantages.

A method of the type mentioned above is disclosed in U.S. Pat. application No. 194,383, note above, where the side guide rails are located in the required spacing for installation and are held in a fixed manner in this mutual position relative to one another, after the support stators have been located and secured in place. Subsequently, the guide rails are positioned with respect to the support member and are then adjusted vertically using the lower surface of the stator as a datum plane. Further, the guide rails are adjusted in the direction transverse to the support member with the abutment of one of the two side guide rails at accurately determined points along the sides of the track support member, followed by the final attachment of the guide rails to the support member. An apparatus for carrying out this method is disclosed in the above application and also in the divisional application, mentioned above. The apparatus includes a number of assembly or installation truss frames arranged parallel to one another and preferably equally spaced apart along the long direction of the support member. The truss frames include assembly arms mounted on each side of the frame and pivotally displaceable toward the support member into a region below the stators. Each assembly arm includes a device for holding a side guide rail and an abutment for contacting the lower surface of the stators. In addition, a transport frame, extending in the long direction of the support member or track, is located along the track and has a length corresponding at least to that of a support member. The installation truss frames are supported on the transport frame so that they can be displaced transversely of the long direction of the track and adjusted in height with respect to the support member.

To position and secure two guide rails along the opposite outer sides of a support member, initially the guide rails are held in the assembly arms pivoted outwardly from the support member. Next, the assembly arms are pivoted inwardly into a spaced position and adjusted with respect to the lower side of the stators by raising the arms in the vertical direction. Following this positioning of the guide arms, a horizontal movement is performed so that one of the side guide rails contacts previously positioned spacer elements at one outer edge of the track support member and this operation is accomplished with support of the truss frame on the surface of the support member. Since the initial position of the side guide rails relative to one another is not altered, the side guide rails at the opposite outer edge of the support member is adjusted at the same time. With the requisite adjustments completed, the side guide rails are secured to the support member.

SUMMARY OF THE INVENTION

Therefore, it is a primary object of the present invention to provide an additional procedure for positioning and adjusting the side guide rails with respect to the support members and to secure the rails to the support members with the required accuracy and at low cost.

In accordance with the present invention, after the stators are adjusted and secured to the track support members, the side guide rails are placed in spaced relation to one another required for their installation and are held in this position for subsequent attachment to the support members. Next, the guide rails are adjusted in the vertical position using the lower side of the stators as a datum plane and then adjusting the guide rails in the transverse direction using measuring points located on the surface of the support members and finally securing the guide rails to the support members.

A measuring point is located at each point where the guide rails are fixed to the support member. Preferably, the measuring points are located on the upper surface of the support members.

An advantage of the present invention is that the side guide rails, held at a specific distance from one another, on the opposite sides of the support member, are place in this spaced relation prior to being mounted on the support member and they can be adjusted in one operation relative to the support member and secured in this position for subsequent securement to the support member. Adjustment of both side guide rails is obtained in the vertical direction by simply raising the assembly arms until contact is achieved with the lower side of the stators already set in place. Adjustment in the transverse direction is obtained by setting the position of the installation truss frames holding the guide rails with respect to a measuring point previously accurately located and fastened to the support member. By simultaneous transverse displacement of the assembly arm carrying the side guide rails, the position of the rails can be secured as previously determined by computation.

It is preferable, for accurately observing the required tolerances, to install the side guide rails in a assembly building with a constant inside temperature. Accordingly, the side guide rails and the support members, previously precast as a finished member, remains in the assembly building as long as necessary for reaching the ambient temperature. It is also possible, however, in accordance with the present invention, to secure the side guide rails at a construction site where the track support members have already been set. In such an operation, the transport frame is arranged to be displaced in the long direction of the track. In this procedure, any damaged attachment points of the side guide rails can be corrected in accordance with the invention.

According to another feature of the invention, the side guide rails can be adjusted along the entire length of at least one track support member in a continuous operation and can be secured to the support member. Such a procedure is achieved with the support members and the side guide rails participating in the absorption of external loads which develop, thereby increasing the load carrying ability and the stiffness of the over-all support structure. In addition, there is the advantage with a frictionally locked connection that any movements between the side guide rails and the support member are prevented.

The side guide rails can be prestressed after adjustment by applying a tension force in the long direction of the track and the rails can be fastened to the support member in the stressed condition at least at the ends for enabling the transmission of force.

Preferably, the guide rails are attached at their ends by welding to steel anchor members previously embedded in the support member.

With the support members formed of reinforced concrete or prestressed concrete, a tension force can be applied to the side guide rails before they are secured to the support member and they can be adjusted so that a compressive prestress is exerted on the concrete support member after the guide rails are attached. A certain compressive prestress is effected on the side guide rails due to force rearrangement because of creeping and shrinkage. This is achieved if the dowel transmittal forces effective between the support member and the guide rails remains smaller than would be the case if the guide rails were not prestressed.

The side guide rails can be secured along their length, in addition to the attachment at their ends, by means of anchor bolts, extending into recesses in the support member, with the recesses then being grouted with a hardenable material, such as cement mortar.

Furthermore, in accordance with the present invention, it is possible to monolithically connect two track support members which initially have been constructed as single span carriers and then arranged in series, by filling the joint between the support member with concrete for providing a continuous support. In addition, the joint between the two support members can be prestressed by stressing members. In such an arrangement, the side guide rails can be continuously installed along the entire length of the two support members. It is possible, however, to connect the side guide rails together, which rails have previously been secured to the individual support members, in a frictional and positive locking manner after the continuous support member effect has been achieved. In such a continuous support member, changes in shape due to temperature differences have less effect than in a statically defined system of single span girders or support members due to the statically indeterminate system used.

An apparatus for carrying out the method described above is also part of the present invention. The apparatus includes a number of installation truss frames located transversely of and along the support member with the truss frame parallel to one another and preferably equidistantly spaced apart. The truss frames have an assembly arm at each opposite side of the support member with the arms extending downwardly to a region below the stators. Each arm has a holding device for engaging one side guide rail and an abutment for contacting the lower surface of the stators. A measuring device, including a measuring head, is located on the truss frame and can be moved into coincidence with a measuring point located on the surface of the support member. Further, a transport frame extending in the long direction of the support member and capable of being supported on the support member, has a length corresponding at least to the length of one support member. The installation truss frames are supported on the transport frame so that they can be displaced transversely of the support member and adjusted in height relative to the support member.

The measuring device is arranged as a measuring caliber or gauge and can be brought into functional connection with the side guide rails in the vicinity of the truss frames independent of the connection with the side guide rails. A measuring device can be provided on each of the assembly arms.

In a preferred arrangement, each assembly arm is pivotally mounted about an axis extending parallel to the long axis of the support member at the ends of a cross beam forming the upper member of a truss frame. The assembly arm can be pivoted by means of pivoting cylinders articulated to the cross beam and to the assembly arm. Each assembly arm can be locked against the cross beam in an inwardly pivoted position.

Displacement units in the form of cylinder-piston units and acting against one another are located for engagement with the outer walls of the support member webs below the roadway surface. Such displacement units can be located at the lower end of the assembly arms for effecting transverse displacement of the installation truss frames. A displacement frame can be provided for each installation truss frame for effecting transverse displacement. Such displacement frames include an upper cross beam and side columns with abutment elements located at their lower ends. The abutment elements can be applied against the outer surfaces of the webs of the support members below the roadway or track with parts of the displacement frames connected to one another in an articulated manner at their ends, the columns are connected with assembly arms by articulated joints, and means for relative displacement in the horizontal direction are located between the cross beam of the displacement frame and the cross beam of the installation truss frame. A spindle drive with a movable spindle is preferably used for the desired displacement.

In a preferred arrangement, the transport frame includes at least two parallel beams extending in the long direction of the track interconnected by transverse beams. The transport frame is supported on the support member, at least at its ends. Rolling meams, including rollers, can be provided for supporting the transport frame on its support member with the rollers moving along cantilevered edges of the support member. Such rolling means comprise frames extending transversely of the transport frame. These frames contact the support member in the region below the stators and are provided with side guide rollers in contact with the webs of the beams extending in the long direction. The rolling means can be provided with its own drive.

The long beams forming the transport frame are combined into a support structure by at least one upper long beam and diagonal rods or members connecting the beams at a specific spacing relative to one another. In such an arrangement, the diagonal rods are parts of a support frame extending transversely of the support structure comprising a transverse beam connected to lower long beams with working platforms located at the ends of such beams. The working platforms are supported in an articulated manner by hangers and are displaceable and fixable by means of a displacement rod.

Rafters or roof trusses can be used in each support frame for carrying a roof covering.

Accordingly, the apparatus is formed as a simple and easily portable device and by means of the apparatus, the side guide rails to be attached to the support member, can be held along their entire length and adjusted relative to the support member in three directions, perpendicular to one another, that is, in the long direction, in the transverse direction, and in the vertical direction.

While adjustment in the long direction occurs while the transport frame is positioned with respect to the support member, the adjustment in the transverse direction and, accordingly, the alignment of the side guide rails, relative to the central axis of the support member, is effected by a measuring device which can be placed in coincidence with one measuring point previously secured on the surface of the roadway girder. Adjustment in the vertical direction takes place with reference to the lower surface of the stators previously installed on the support member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 6 is a schematic side view of the apparatus embodying the present invention viewed in the long direction of the support member;

FIG. 7 is a partial cross-sectional view taken along the line VII—VII in FIG. 6 with assembly arms displayed in the outwardly pivoted position;

FIG. 8 is a partial cross-sectional view taken along the line VIII—VIII in FIG. 6 with the assembly arm disposed in the inwardly pivoted position;

DETAILED DESCRIPTION OF THE INVENTION

Figure 1:
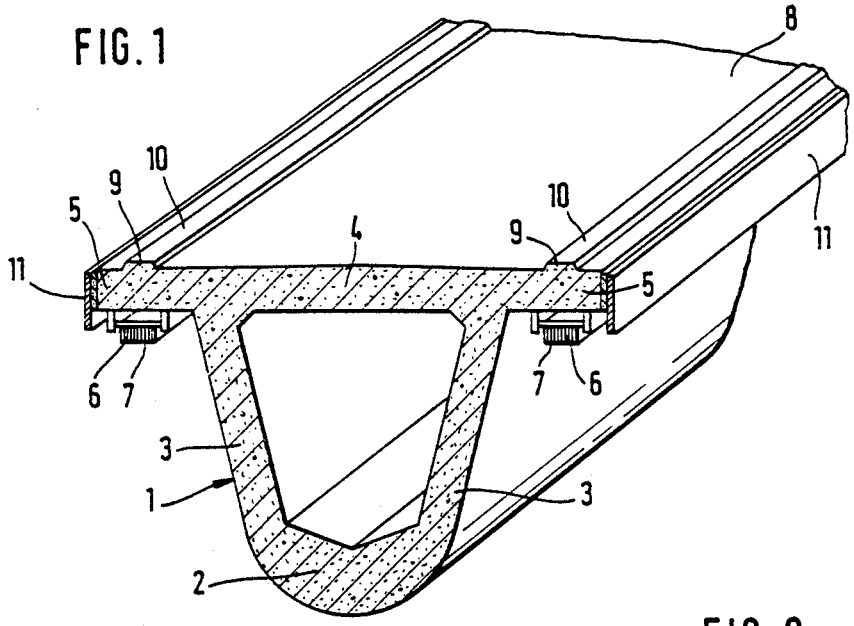
FIG. 1 is a transverse cross-sectional view of a track support member formed of prestressed concrete mounting operating elements for electromagnetically levitated vehicles, not shown.

In FIG. 1, the arrangement of operating parts and operating surfaces for an electromagnetically levitated vehicle are shown on a beam-like track support member 1 formed of prestressed concrete with a closed approximately trapezoidally shaped hollow beam cross section. The beam-like support member 1 includes a base portion 2 rounded at its lower outer surface, and upper deck slab 4 is supported at the upper ends of webs 3 extending upwardly from the base portion to the underside of the deck slab 4. Base portion 2, webs 3 and the lower surface of the deck slab 4 combine to form the hollow trapezoidal section. Deck slab 4 extends laterally outwardly from the webs 3 forming cantilevered parts 5. Support member is elongated, note FIG. 6. The operating surfaces for the running track of the magnetic railroad are located in the region of the cantilevered parts 5.

Figure 2:
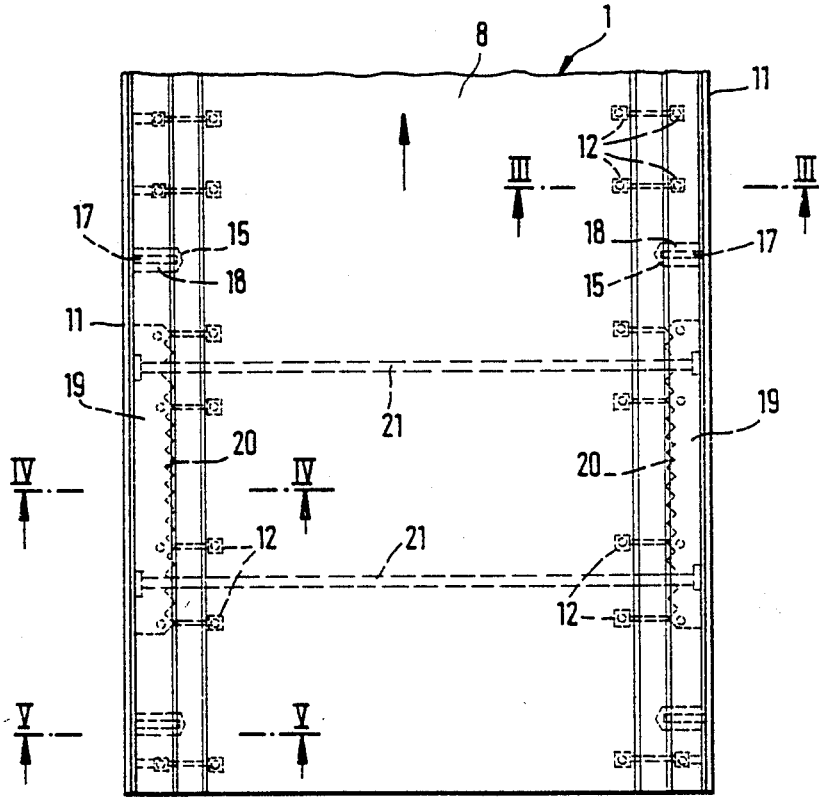
FIG. 2 is a schematic plan view of one end of the support member.
Figure 3:
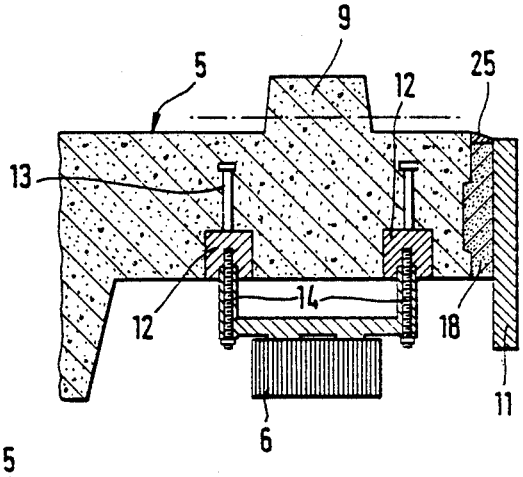
FIG. 3 is cross-sectional view taken along the line III—III in FIG. 2 and shown on an enlarged scale.

The operating parts include levitating stators 6 located on the undersides of the cantilevered parts 5 with the lower surfaces 7 of the stators forming operating surfaces. These operating surfaces must have a specific spacing from slide surfaces 10 formed on slide strips 9 projecting upwardly from the upper surface of the cantilevered parts 5. Additional operating surfaces are provided by the elongated side guide rails 11, each located along one of the elongated outer sides of the cantilevered parts 5. The present invention is not directed to the manner in which the stators 6 equipped with stators windings are secured to the underside of the cantilevered parts 5 of the support member 1. It is important that the stators are secured previously to the track support member. As shown in FIG. 2, anchor members 12, including anchor bolts 13, are arranged to be anchored in the concrete of the support member 1. The anchor members 12 and the anchor bolts 13 are also shown in FIG. 3. The anchor members are spaced apart at distances determined by the dimensions of the stator 6. Threaded bores are provided in the anchor members 14 for the attachment screws 14 of the stator 6.

Various steps are required for aligning, positioning and securing the side guide rails to be described with the aid of FIGS. 2 to 5.

Figure 5:
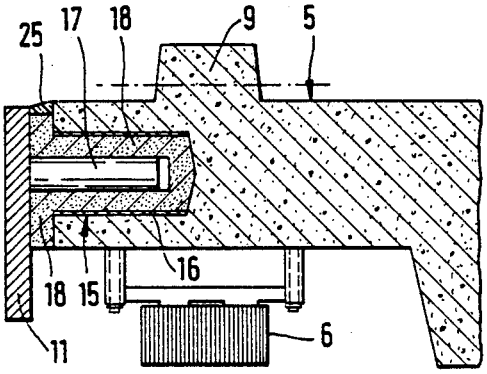
FIG. 5 is a transverse cross-sectional view taken along the line V—V in FIG. 2 and set forth on an enlarged

In FIG. 5, recesses 15 are shown extending into the elongated outer side of the cantilevered parts 5 and the recesses are provided in the elongated direction of the support member 1. Recesses 15 can be provided by hollow molded members 16 incorporated when the support member is concreted. The recesses can also be formed by removable molded members. Recesses 15 are arranged to receive anchor bolts 17 which are preferably welded to the inside surfaces of the side guide rails 11 at appropriate spaces in the elongated direction. The inner surfaces of the guide rails 11 are the surfaces facing inwardly toward the outer sides of the cantilevered parts. After the final positioning of the side guide rails 11, with the anchor bolt in place within the recesses 15, the recesses are filled with a hardenable material, such as cement mortar 18, note FIGS. 2 and 5.

Figure 4:
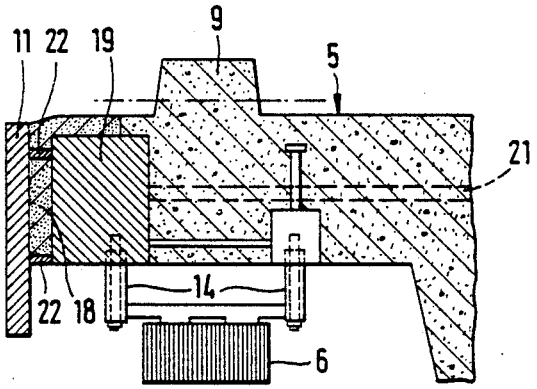
FIG. 4 is a transverse cross-sectional view taken along the line IV—IV in FIG. 2 and displayed on an enlarged scale.

If a tension force in the elongated direction is applied to the side guide rails 11 before they are secured to the support member 1, steel anchoring members 19 are incorporated into the concrete at the end part of the support member 1, as shown in FIGS. 2 and 4. Anchoring members 19 are provided with a set of teeth extending in the elongated direction for improving the transmission of shear forces to the concrete body of the support member. Further, tendons 21, extending transversely of the elongated direction interconnect the anchoring members 19 located on opposite sides of the support member 1. As shown in FIG. 4, threaded bores are formed in the anchoring members 19 for receiving the stator attachment screws 14. Spacers 22 are attached along the outer surface of the anchoring members for the alignment and attachment of the side guide rails 11. The side guide rails are secured to the spacers by welding.

After adjustment of the side guide rails 11, to be described subsequently, the space remaining between the side guide rails 11 and the outer side of the cantilevered parts 5, is filled with a hardenable material, such as cement mortar 18 simultaneously with the grouting of the recesses 15. The space is sealed in its upper region by a permanent elastic seal 25, note FIGS. 3 and 5. An apparatus 30 serves for carrying out the method of the present invention and it is diagrammatically illustrated in FIGS. 6 to 8, as well as in a more detailed form in FIGS. 9 to 15.

As shown best in FIG. 6, apparatus 30 includes a plurality of installation truss frames 31 uniformly spaced apart along the length of the track support member 1 with the truss frames extending transversely of the support member and parallel to one another. A pair of adjacent installation truss frames 31 are interconnected by a wind braking connection 32, and the interconnection is arranged so that horizontal and vertical movements required for positioning of the side guide rails can be effected independently of one another.

As can be seen in FIGS. 7 and 8, each installation truss frame is formed of a truss-like member 33 spaced upwardly from the upper surface of the support member 1. Member 33 has an upper cross beam 34 and a lower cross beam 35, with vertical and diagonal beams 36 interconnecting the upper and lower cross beams. Each installation truss frame has a side assembly or installation arm 37, 38, each connected to an opposite end of the upper beam 34 with a left-hand assembly arm 37 shown in FIG. 7 and a right-hand assembly arm shown in FIG. 8. The assembly arms 37, 38 are pivotally connected at the outer ends of the upper beam 34 with the member 33 so that each arm is pivotally movable about a joint 39 with the axis of the joint extending in the elongated direction of the support member 1. In FIG. 7, the pivoting movement is indicated by an arrow 40 and is effected by cylinder piston units or so-called arm pivoting cylinders 41. The cylinders 41 are located adjacent the upper ends of the arm 37, 38 and extend between the arm and the member 33.

The apparatus 30, as shown in FIG. 6, is displayed in FIG. 7, on the left-hand side, with the arm in the outwardly pivoted or open position and in FIG. 8, on the right-hand side, with the arm 38 in the inwardly pivoted or closed position. Each assembly arm 37, 38 has a holding device 42 located in its lower region for holding the side guide rails 11. In addition, at the lower end of each arm there is a stator abutment 43 which can be move inwardly into contact with the lower surface 7 of the stator 6, note FIG. 8. These retention devices are not a subject of the present invention and, therefore, are not described in detail.

The installation truss frame 31 rests on a transport frame 45 formed of two beams 46, extending in the long direction of the track and the long beams are connected by cross beams 47, mainly at the locations of the assembly arms 31.

If the apparatus 30 for carrying out the method of the present invention is used in an assembly plant, it can be placed on the beam-like support member using a suitable hoist. Such a hoist engages into carrying eyes 48 located on the transport frame 45. In the embodiment illustrated in FIG. 6, the long beams 46, forming the transport frame 45, are combined into a support structure 50 by an additional upper long beam 49. The support structure includes support frames 51 extending perpendicularly to the long beams 46 and 49 and these support frames are arranged between the truss frames 31.

Figure 15:
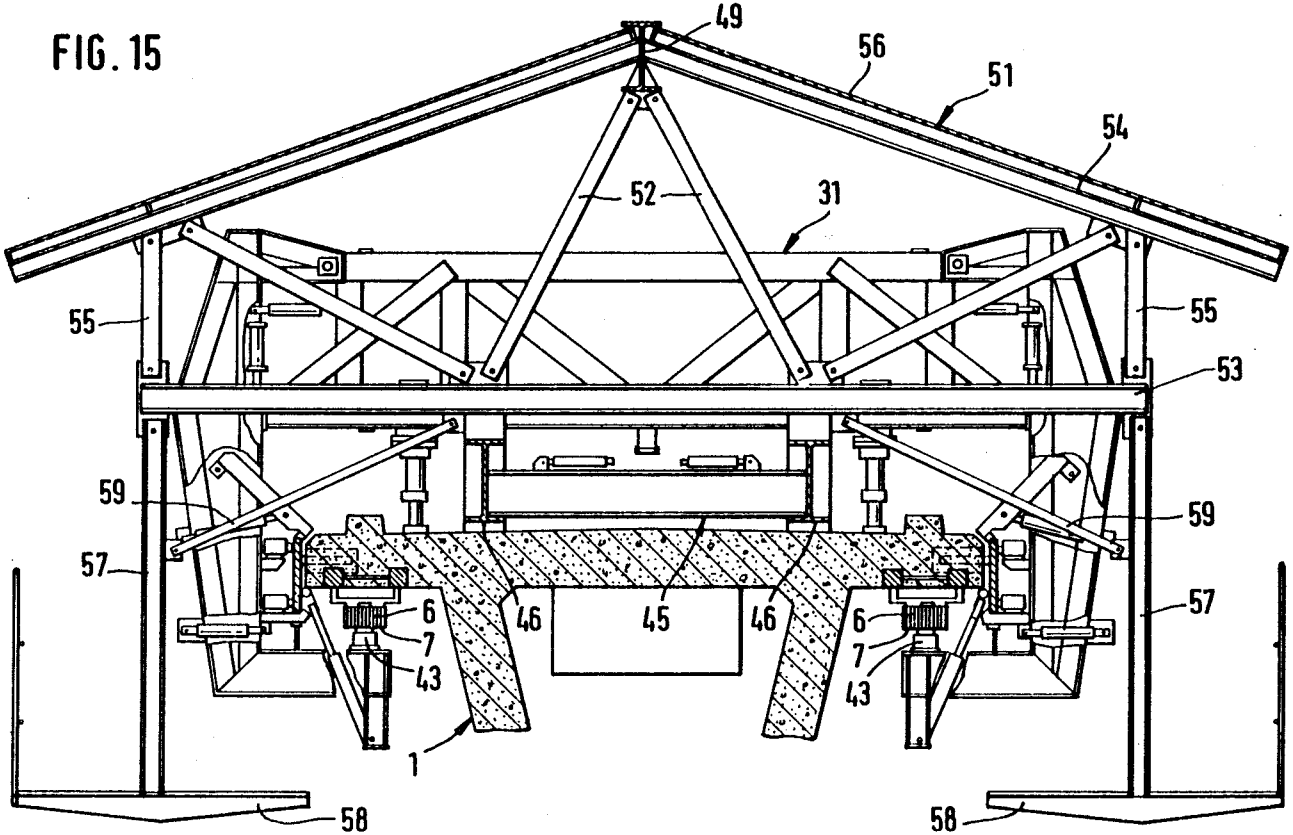
FIG. 15 is a cross-sectional view of the apparatus displayed in FIG. 6 and taken along line XV—XV in that FIG.

The lower long beams 46 are the main elements of the support structure 50, shown in cross section in FIG. 15, with the beams 46 connected with the upper long beam 49 by upwardly extending diagonal rods 52. Support frames 51 are completed by a transverse beam 53 bearing on the lower long beams 46 and connected with such beams and with a roof structure of rafters 54, also connected to the upper long beam 49. The rafters 54 rest on the upper ends of vertical columns or members 55 and carry a roof covering 56 Additional vertical rods or columns 57 are suspended from the transverse beam 53 and a working platform 58 is secured to the lower end of the columns 57. Columns or rods 57 are hung in an articulated manner and can be positioned by an adjustment rod 59 to place them in a horizontal plane if the apparatus negotiates a curve.

Figure 16:
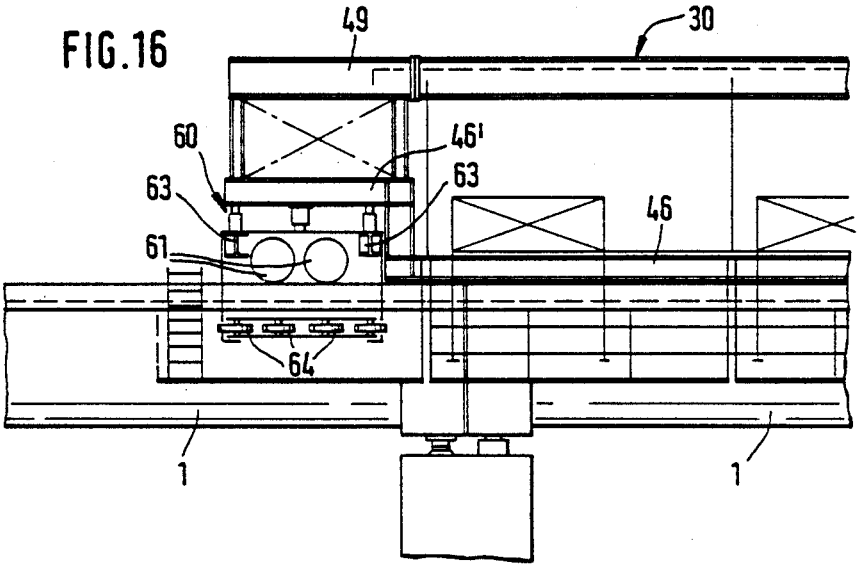
FIG. 16 is a side view of an end of the apparatus of the present invention showing a rolling mechanism and illustrated on an enlarged scale.
Figure 17:
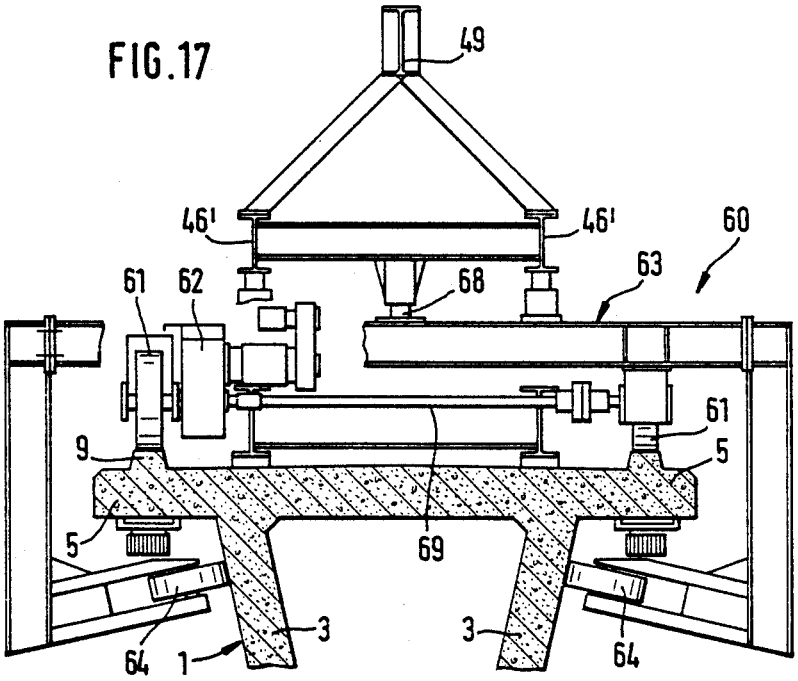
FIG. 17 is a cross-sectional view of the apparatus in the region of the rolling mechanism taken along the line XVII—XVII in FIG. 6.

As shown in FIG. 6, apparatus 30 has rolling mechanisms 60, at least at its ends. In case of longer lengths, rolling mechanisms may be provided at intermediate locations. One embodiment of the rolling mechanism 60 is displayed in FIGS. 16 and 17. Rolling mechanism 60 includes traveling rollers 61 positioned in the region of an angle bend 46' and supported on a rolling mechanism frame 63 rotatable about a rotary trunnion 68. Rolling mechanism 60 contacts the track support member below the cantilevered parts 5 and has adjustable side guide rollers 64 which abut against the webs 3 of the support member. The number of side guide rollers 64 depends on the magnitude of the side force. Two rolling mechanism frames 63 are provided for each rolling mechanism.

Air cushions with appropriate side guidance devices can be used for support in place of the rolling mechanism 60. Such alternate arrangements has the advantage of a particularly uniform load distribution by arranging several such air cushions along the length and width of the support member. The shifting or displacement of forces are minimized as is the case with the magnetic gap.

FIG. 7 shows the arrangement of the apparatus 30 with the assembly arms 37, 38 in the outwardly pivoted position. In this position, two side guide rails 11, to be fastened to the support member 1, are inserted by a suitable hoist into the holding devices 42 on the assembly arms 37, 38 and they are fixed at a selected spacing. At this time, the anchor bolts 17, note FIG. 5, are secured to the side guide rails 11. With the pivotal displacement of the assembly arms 37, 38, the pivotally inward displacement as shown by the arrow 40 is provided by the cylinders 41 at the upper ends of the assembly arms. During this movement, care must be taken that the anchor bolts 17 are inserted into the recesses 15. It may be necessary to raise the assembly arms 31 slightly to insure such insertion, and this can be effected by elevating presses 65 depending downwardly from the lower cross beam 35 of the truss-like member 33. The presses 65 abut against the upper surface 8 of the support member 1, note FIG. 8. In place of raising the side guide rails 11, using a hoist they can be positioned by a leading trolley, that is, they can be introduced with the anchor bolt into the recesses and held by retention stirrups until the time when the apparatus 30 and the holding devices 4 move over them and fix them in place.

Figure 9:
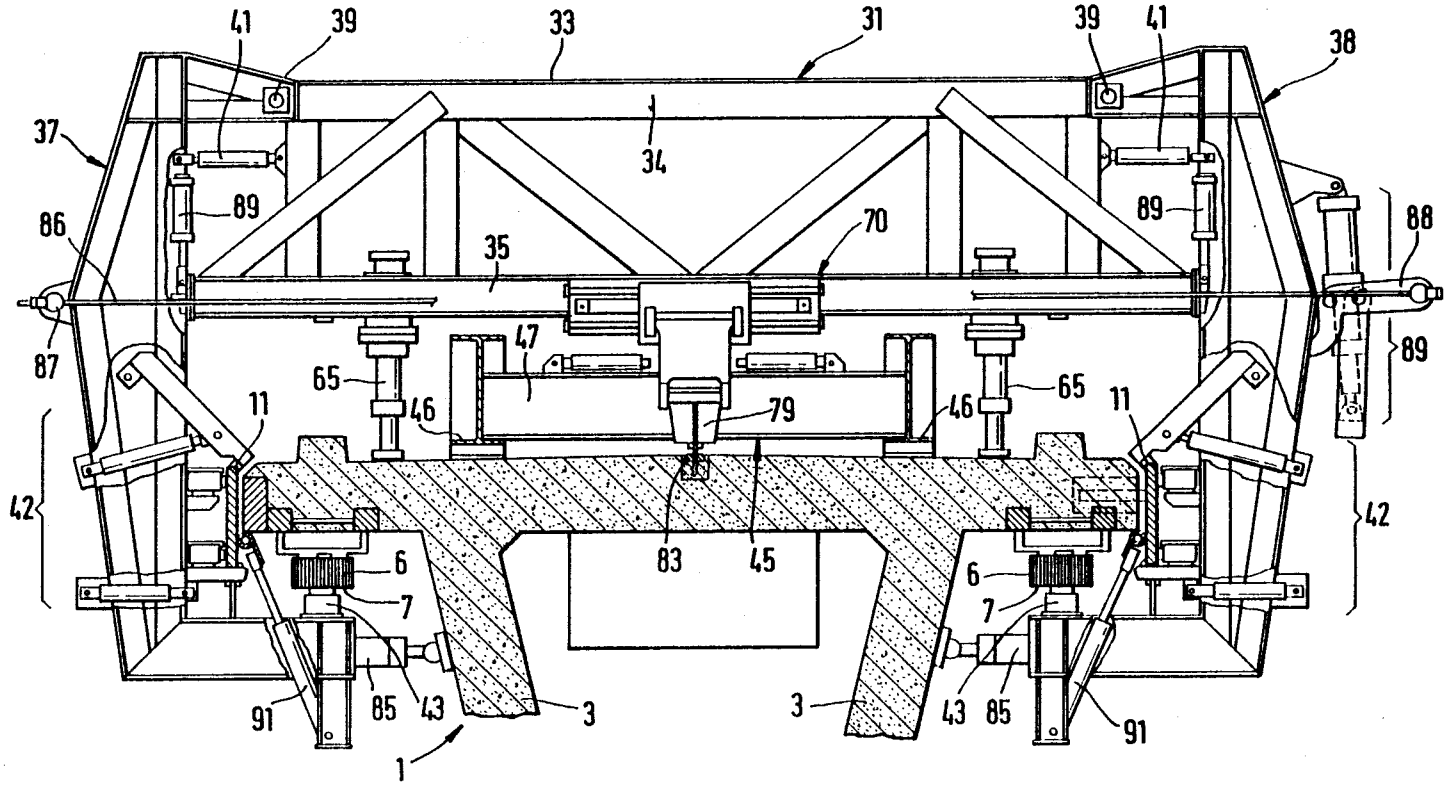
FIG. 9 is full transverse cross section of the apparatus embodying the present invention with the assembly arms in the inwardly pivoted position and displayed on an enlarged scale relative to FIGS. 7 and 8.
Figure 10:
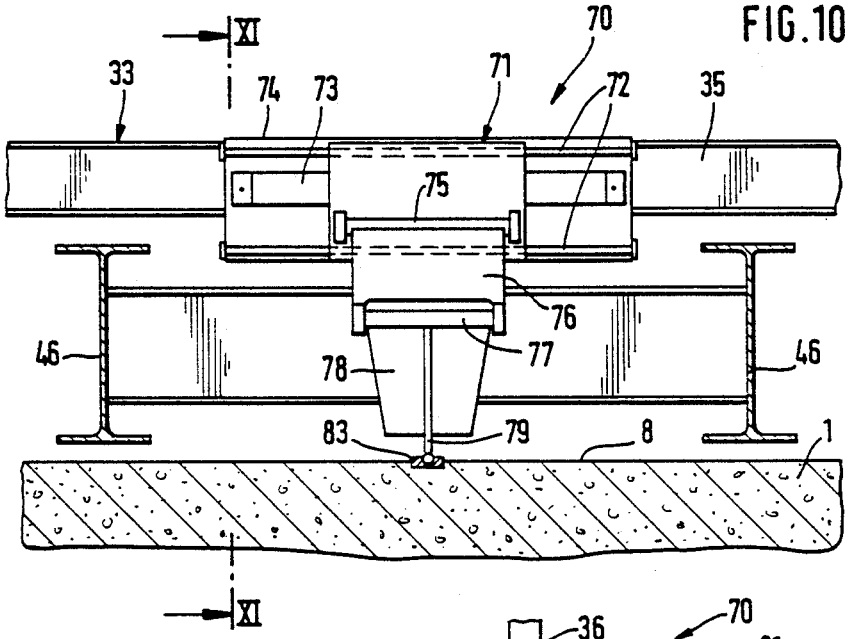
FIG. 10 is in elevational view of a measuring device embodying the present/invention.

After the assembly arms 37, 38 are closed, note FIG. 8, or after fastening the side guide rails positioned in another manner in the holding devices 42, the installation truss frames 31 are raised through a height h in the direction of the arrow 66 by actuating the elevating presses 65 until the stator abutments 43 contact the lower surface of the stators 6, whereby the side guide rails 8 are aligned in height. The alignment in the transverse direction, note arrow 67, is made by horizontal displacement with respect to a measuring point with the help of a measuring device, as displayed in FIGS. 9–12. FIG. 9 is a cross-sectional view through the support member 1 and the apparatus 30 illustrating the assembly arms 31. A measuring device is positioned on the lower cross beam 35 of truss-like member 33, with the measuring device identified by the reference numeral 70. Measuring device 70 is displayed on an enlarged scale in FIGS. 10 and 11.

Figure 11:
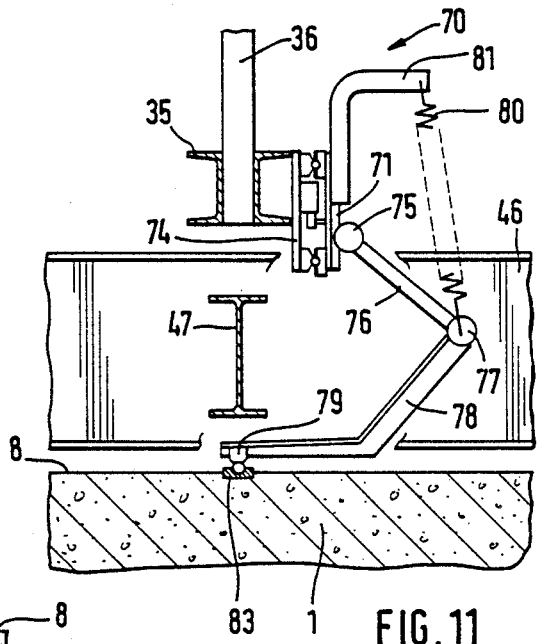
FIG. 11 is a transverse sectional view through the measuring device shown in FIG. 10 and taken along the line XI—XI.
Figure 12:
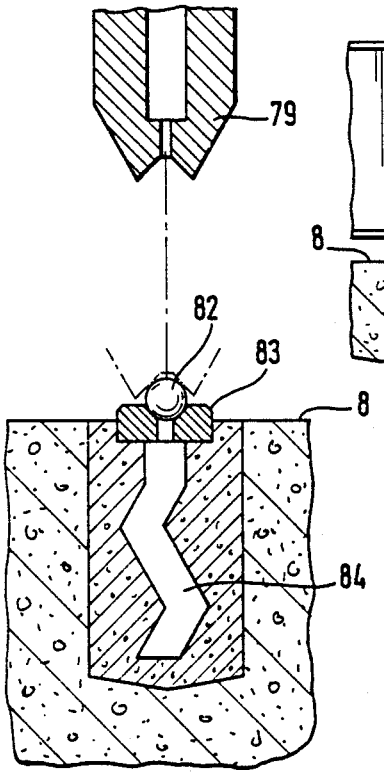
FIG. 12 is a cross-sectional view of a detail of a measuring point.

As shown in particular in FIG. 11, the measuring device 70 includes a flange 71 displaceable in the horizontal direction parallel to the lower cross beam 65 along a measuring rod 73. Measuring rod 73 is secured to a retention plate 74 along with the guide rail 72 with the retention plate extending along the lower cross beam 35. The flange 71 supports a pivoting arm 76 pivotally mounted on an axis 75. A measuring arm 78 with a measuring head 79 is attached to the pivoting arm 76 so that it can be pivoted around a axis 77. Measuring arm 78 is suspended by a tension spring 80 from a gallows-like boom 81 so that it is balanced weightwise. The flange 71 with the measuring head 79 can be precisely aligned or coincided with a measuring point 83 formed by a measuring ball 82. The measuring point is placed in the upper surface of the deck slab 4 and is secured by an anchor bolt 84, note FIG. 12.

After the assembly arm have been pivoted inwardly and the truss frames 31 have been adjusted vertically relative to the lower surface of the stators 70, as described above, the truss frames 31 ar fixed with respect to the webs 3 of the support member 1, note FIG. 9, by extending the actuating elements 85. Actuating elements 85 are hydraulically driven cylinders, however, spindles with a fine adjustable drive can also be utilized.

To avoid deformation of the truss frames 31 during the following procedures, it is appropriate not only to latch the assembly arms 37, 38, but also to clamp them against one another. The clamping action can be effected by stress members 86 anchored in tension at the assembly arm 37 by an anchorage 87 and by fastening the opposite end of the stress members to an elbow lever 88 on the assembly arm 38 so that the elbow lever can be pivoted by a stressing device 89. By means of the stressing device 89, it is possible to stress the tendons 86 and to release the stress so that the assembly arms 37, 38 can be pivoted outwardly. To adjust the side guide rails in the horizontal transverse direction, the measuring head 79 of the measuring device 70 is moved into coincidence with the measuring ball 82 mounted on the measuring point 83, note the dashed line showing in FIG. 12. This position is reached after fixing the truss frames 31 relative to the support member 1 and results in a reading at the measuring rod 73. From the position of the measuring head 79, with respect to the measuring point 83, which point was set previously by contemporary survey technology, information regarding the actual position of the side guide rails 11 can be obtained and then is moved into the desired position determined by computer. The truss frames 31 can now be displaced horizontally through a differential amount by means of the actuating elements 85, note FIGS. 7 and 8. As soon as the side guide rails 11 have been placed in the predetermined position, they are secured in place by filling the recesses 15 with a hardenable material.

After the side guide rails 11 are held in the prescribed manner and adjusted relative to the support member 1, they can be prestressed and fastened in the stressed condition to the support member 1. Prestressing devices 90, one is shown schematically in FIG. 6, are provided for prestressing the side guide rails. Prestressing devices 90 are equipped with hydraulic cylinder-piston units, connected by a cross beam with tension shackles and at the same time abutting against an end of the support member 1, with the tension shackles connected at their ends to each of a different one of the side guide rails 11. After stressing the side guide rails 11, their ends are welded to a anchoring member 19 shown in FIGS. 2 and 4, before grouting the recesses 15 and the spaces between the side guide rails 11 and the outer sides of the cantilevered parts 5 with a hardenable material, such as a cement mortar. To prevent the cement mortar from flowing out of the spaces during the grouting operation, sealing elements of an elastic material can be provided with are pressed into the space.

After the hardenable material has set, the sealing elements are removed so that the installation truss frame 31 can be lowered onto the long beams 46 of the transport 45 by retracting the elevating cylinders 65. Centering of the truss frames 31 with respect to the transport frame 45 is possible by a centering device which need not be describe in detail, in order to adjust new side guide rails 11.

Figure 13:
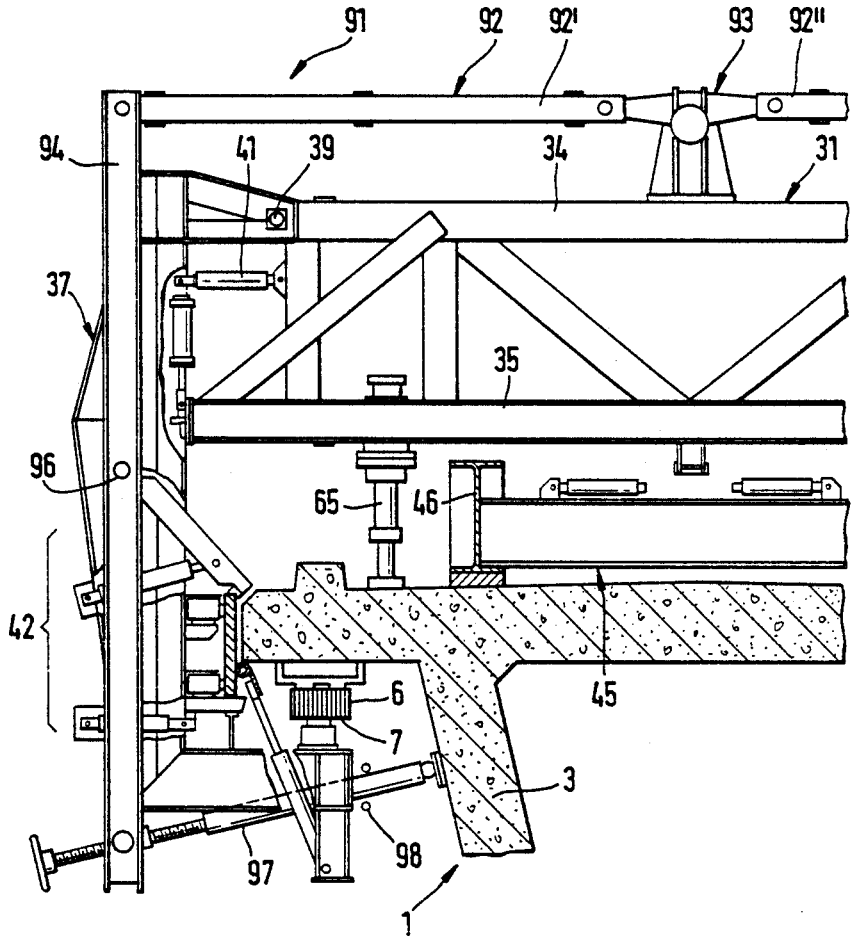
FIG. 13 is a partial cross-sectional view through another embodiment of the apparatus incorporating the present invention with the assembly arm illustrated in the inwardly pivoted position.
Figure 14:
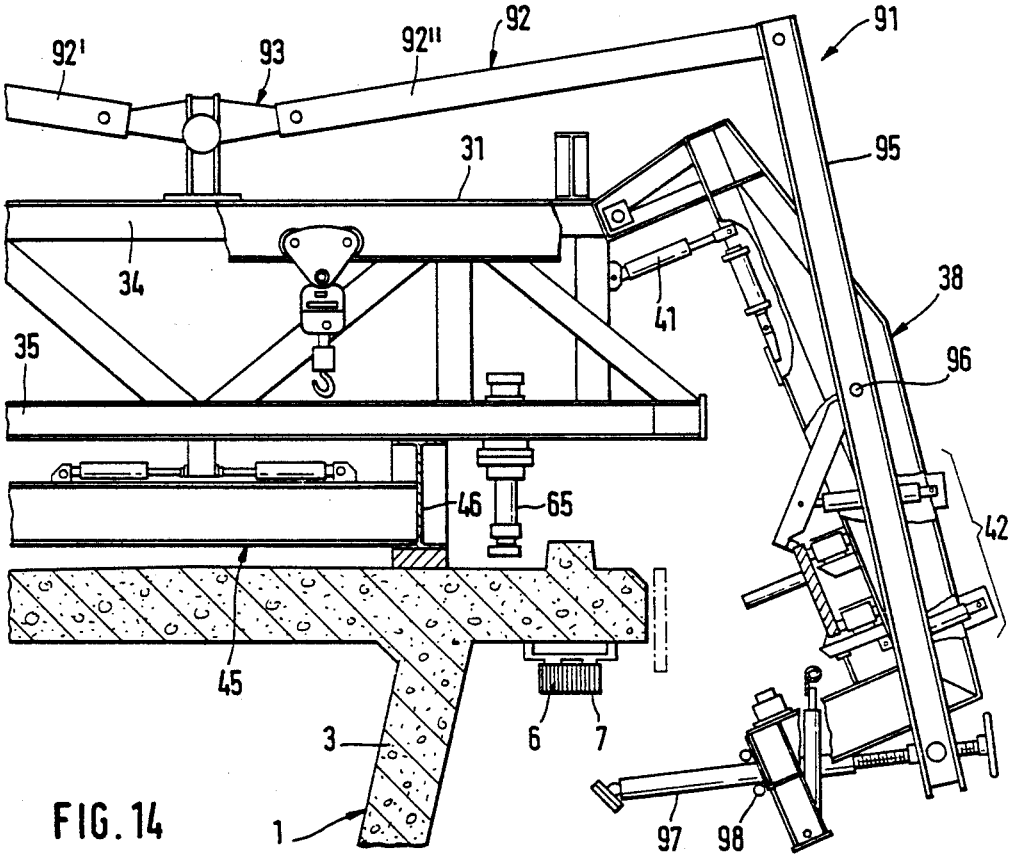
FIG. 14 is a cross-sectional view similar to FIG. 13, however, displaying the assembly arm in the outwardly pivoted position.

Another embodiment for horizontal displacement of the truss frames 31 with respect to the support member 1 for the adjustment of the side guide rails 11 is displayed in FIGS. 13 and 14. In this embodiment, a frame 91 is provided for each of the installation truss frames 31 and has a similar form to the truss frame and is connected to it in an articulated manner. Each frame 91 has an upper cross tie 92 formed of two parts 92', 92'' connected together in an articulated manner at a central spindle drive 93 fastened on the upper cross beam 34 of the truss frame 31. Vertical columns 94, 95 are fastened at the outer ends of the two parts 92', 92'' and the columns extend parallel to the vertical columns of the assembly arms 37, 38 and are connected to the arm by joints 36 approximately at the level of the lower cross beam 35 of the truss-like member 33. Abutment elements 97 are connected in an articulated manner with the lower ends of the columns 94, 95 and the abutment elements are retained in guides 98 and act against the webs 3 of the support member 1. Similar to the showing in FIGS. 7 and 8, the column 95 of the frame 91 and the assembly arm 38 associated with it are shown in the outwardly pivoted state in FIG. 14 and the column 94 and its associated assembly arm 37 are displayed in the inwardly pivoted state in FIG. 13.

In the inwardly pivoted state with the side guide rails in position, the abutment elements 97 are placed in contact with the webs 3. As described above, the amount of horizontal displacement of the respective truss frame 31 is determined by the measuring device 70 and the truss frame 31 is shifted with regard to the frame 91 by actuating the spindle drive 93 formed of a movable spindle and a stationary nut. The frame 91 forms the articulation points.

Figure 18:
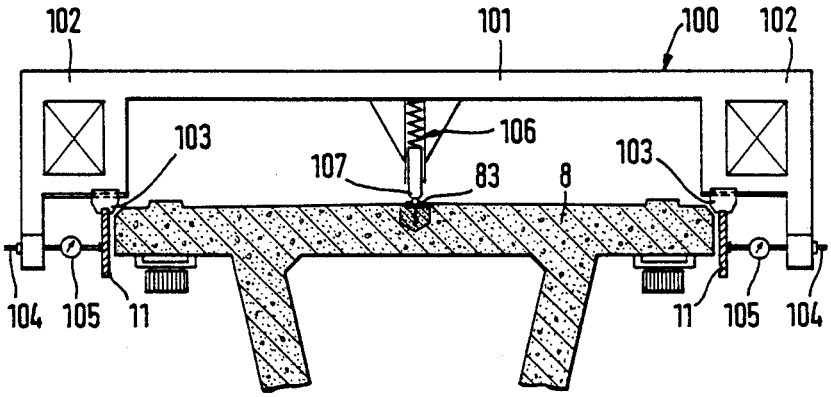
FIG. 18 is a partial transverse view of a support member showing a measuring gauge for adjusting the side guide rails.

While in the embodiments described above, a dedicated measuring device 70 is assigned to each of the installation truss frames 31, it is also possible to use one or more relocatable measuring gauges, which are consecutively assigned each to one of the truss frames 31. Such a measuring gauge or caliber 100 is illustrated in FIG. 18. Measuring gauge 100 includes an upper cross beam 101 with side heads 102 at the opposite ends thereof. Retention devices 103 are located on the side heads 102 for guiding the side guide rails 11. In addition, the side heads 102 carry spindles 104 with measuring dials 103 at the level of the side guide rails 11. In addition, a measuring device 106 comparable to the measuring device 70, is located on the cross beam 101 and its measuring head can be placed in coincidence with a measuring point 83 located in the upper surface of the support member. With such a measuring gauge, it is possible to position the side guide rails 11 at a fastening point with respect to the measuring point 83, where the measuring point has been determined by surveying technology, whereby it is secured by the measuring devices 42 of the assembly arms 37, 38 and can be fixed to the support member by grouting with a hardenable material, such as cement mortar.

In accordance with the present invention, it is not only possible to provide the adjustment and attachment of side guide rails at support member constructed as single span girders, but it is also possible to adjust and fasten the side guide rails to support members which are continuous over at least two bridge spans. It is also possible to connect side guide rails already installed on serially laid single span support members across butt joints if the support members are monolithicaly connected together by filling a joint between them with concrete in order to establish a continuous support member. Such an arrangement is set forth in FIGS. 19 to 21.

Figure 19:
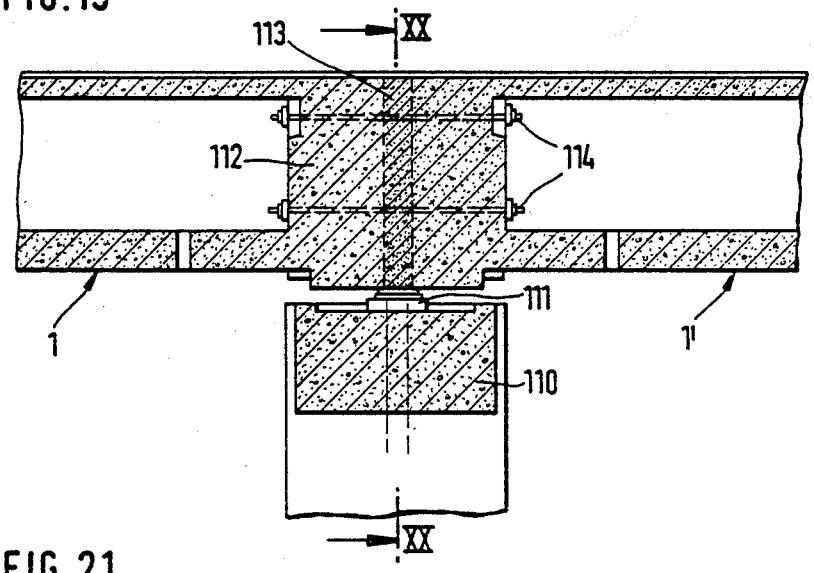
FIG. 19 is a cross-sectional view taken in the long direction of the support members and displaying a junction of two serially arranged support members for effecting a continuous beam effect.

FIG. 19 is a section in the long direction of the support members 1, 1' with such members bearing on a bearing support 111 on a support head 110. The butt joint gap or space between the end to the beams 112 of the support members 1, 1' is filled with concrete 113 poured in place. In addition, tendons 114 extend between the end beams 112 and across the butt joint between them.

Figure 20:
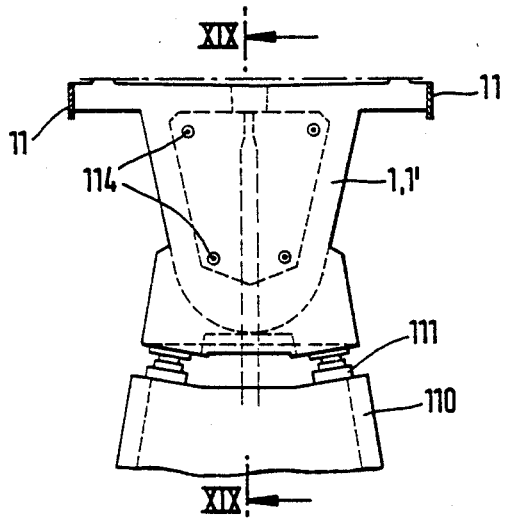
FIG. 20 is a. cross-sectional view taken along the line XX—XX in FIG. 19.
Figure 21:
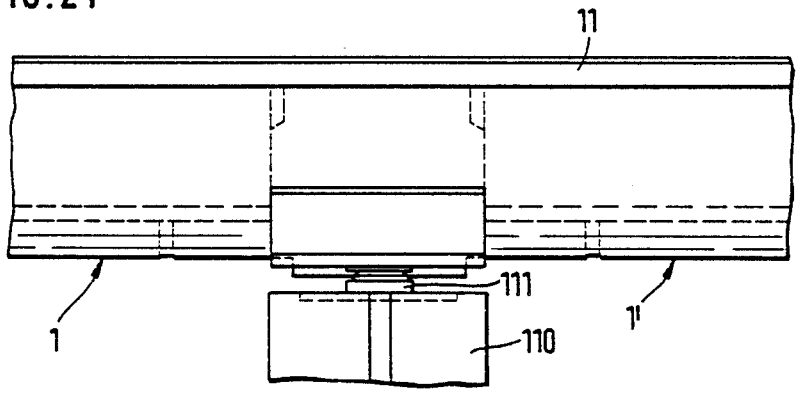
FIG. 21 is a side view of the junction of the two support members set forth in FIG. 19.

The cross section taken along the line XX—XX in FIG. 19 is set forth in FIG. 20 and shows how the side guide rails 11 extend in the upper region of the support member 1 and can be relied upon as part of the concrete reinforcement in the support region of the member.

If the side guide rails 11 are secured after providing the continuity of the two support members 1, 1', then the support members are installed without guide rails. They are equipped at the ends of the continuous support members with embedded anchoring members 19, note FIG. 2, for frictionally locking connection of the side guide rails. Further, recesses 15 are provided for attachment of the side guide rails 11. After the space between the support members 1, 1' is filled with concrete 113, poured in place, and after the clamping or stressing the support members by means of the tendons 114, continuous side guide rails 1 are installed along the over-all length of the continuous support members and the load carrying connection at the end of the support member is produced by welding the side guide rails 11 to the anchoring members 19.

If the frictionally locked connection of the side guide rails 11 is previous provided along the single span support members 1, 1' in the region of the connecting space of the continuous support member, then each support member is provided with appropriate anchoring members 19 at its end.

After continuity has been established by filling the connecting space with concrete and pressing the girders together, a frictionally locked connection is provided for the side guide rails 11 across the connection space.

While specific embodiments of the invention have been shown and described in detail to illustrate the application of the inventive principles, it will be understood that the invention may be embodied otherwise without departing from such principles.

We claim:

1. Method of adjusting and securing operating surfaces of a track for electromagnetically levitated vehicles formed of an elongated beam-like support member constructed of at least one from the group consisting of steel, reinforced concrete or prestressed concrete, and having a generally horizontal upper surface over which the vehicles run and an oppositely directed lower surface and upwardly extending outer sides extending between the upper and lower surfaces in the elongated direction of the support member, and where the operating surfaces are formed by stators and side guide rails, wit the stators in position on the lower surface of the support member with each stator located adjacent to and extending generally parallel along one of the outer sides of the support members, comprising the steps of positioning and holding a side guide rail on each side of said support member and extending in the direction of the outer sides, moving each of the held side guide rails adjacent to a different one of the outer sides thereof and locating the held side guide rails relative to the support member in a predetermined spacing relative to one another, positioning the held and spaced side guide rails in the vertical direction relative to a downwardly facing surface on the adjacent stator, locating fixing points along the outer sides for fixing said side guide rails to the support member, fixing measuring points to the upper surface of the support member, and adjusting the held and spaced guide rails in the direction transversely f the support member relative to the measuring points, and finally securing the side guide rails to the support member.

2. Method, as set forth in claim 1, including the step of providing a measuring point for each fixing point of the side guide rails.

3. Method, as set forth in claim 2, including the step of locating the measuring points on the upper surface of the support member.

4. Method, as set forth in claim 1, including the step of adjusting and securing the side guide rails continuously along the full length of at least one support member.

5. Method, as set forth in claim 1, including the steps of after locating the held side guide rails relative to the support member in a predetermined spacing relative to one another and positioning the held and spaced side guide rails in the vertical direction, prestressing the side guide rails by applying a tension force in the long direction of the support members and securing the prestressed guide rails at least at the ends thereof to the support member.

6. Method, as set forth in claim 5, including the step of fastening the ends of the side guide rails to steel anchoring members embedded in the support member.

7. Method, as set forth in claim 6, including the step of welding the ends of the side guide rails to the anchoring members.

8. Method, as set forth in claim 6, including the step of fastening the side guide rails along the length thereof to said support member by inserting anchor bolts connected to the side guide rails into recesses in the outer side of the support member and grouting hardenable material into any space between said side guide rails and the outer sides of said support member.

9. Method, as set forth in claim 8, including the steps of arranging at least a pair of the support members in end-to-end series with the adjacent ends of the support members disposed in spaced relation, providing a monolithic connection between the adjacent ends, connecting the adjacent ends by stressed tendons, and connecting the side guide rails to the interconnected support member with the side guide rails bridging the concreted space between the adjacent ends.

10. Apparatus for positioning and securing operating surfaces of an elongated generally horizontal track for electromagnetically levitated vehicles comprising a plurality of generally vertically extending installation truss frames disposed in spaced parallel relation with said frames arranged to extend transversely of and above the track, said installation frames each having a pair of outer generally upwardly extending assembly arms with each said assembly arm pivotally attached to an opposite end of said installation truss frames for pivotal displacement towards and away from the track, each said assembly arm having holding means for holding one side guide rail and an abutment at a lower part thereof for abutting against a lower surface of a stator attached to a lower surface of the track, a measuring device including a measuring head mounted on each said installation truss frame, said measuring head arranged to be brought into coincidence with a measuring point on an upper surface of the track, a transport frame extending in the elongated direction of the running track, said transport frame having a length in the elongated direction thereof corresponding to at least one track section, said installation truss frames supported on said transport frame for movement transversely of the elongated direction and for adjustment in height relative to the track.

11. Apparatus, as set forth in claim 10, wherein said measuring device comprises a measuring gauge movable into effective connection with the side guide rails and movable independently of the truss frames into the region of the guide rails.

12. Apparatus, as set forth in claim 10, wherein said measuring device is secured to each said truss frame.

13. Apparatus, as set forth in claim 10, wherein said assembly arms are each pivotally displaceable about an axis extending parallel to the elongated direction of the support member located at the ends of a cross beam forming an upper cross beam of the truss frame.

14. Apparatus, as set forth in claim 13, wherein means for pivoting the assembly arms connected to said cross beam and said assembly arms.

15. Apparatus, as set forth in claim 13, wherein said assembly arms are securable to said cross beam in a position pivoted inwardly toward said support member.

16. Apparatus, as set forth in claim 10, wherein elements on opposite sides of said support member arranged to contact said support member below an upper portion thereof, and located at the lower ends of said assembly arms for displacing said truss frame in the direction transverse to the elongated direction of the support member.

17. Apparatus, as set forth in claim 16, wherein said elements comprise cylinder-piston units.

18. Apparatus, as set forth in claim 10, wherein a frame associated with each of said truss frames for effecting transverse displacement of said truss frames, said frame comprising an upper cross beam, vertically extending side columns extending downwardly from said upper crossbeam, abutment elements located at the lower ends of said columns, said abutment elements arranged to contact said support member below the upper surface thereof, and said frame having parts connected together at ends thereof in an articulated manner, and said columns connected to said assembly arms via joints and means for effecting relative displacement in the horizontal direction transverse of the elongated direction between the upper cross beam and a cross beam of said truss frame.

19. Apparatus, as set forth in claim 18, wherein said means for relative displacement comprises a spindle drive with a movable spindle.

20. Apparatus, as set forth in claim 10, wherein said transport frame comprises at least two parallel beams extending in the elongated direction of said support member and interconnected by a cross beam.

21. Apparatus, as set forth in claim 20, wherein said transport frame at least at the opposite ends thereof in the elongated direction of the support member being displaceably supported relative to the support member.

22. Apparatus, as set forth in claim 21, wherein rolling mechanism with travelling rollers located at least at the opposite ends of said transport frame and arranged for abutment with the support member with said rollers rolling on slide ledges on an upper surface of the support member.

23. Apparatus, as set forth in claim 22, wherein said rolling mechanism comprises a rolling mechanism frame extending transversely of the elongated direction of the transport frame, said rolling mechanism frame including means for contacting the support member at a location below stators supported thereto and said rolling mechanism frame including side guide rollers for abutment with said support member below the stators.

24. Apparatus, as set forth in claim 22, wherein each said rolling mechanism has a dedicated drive.

25. Apparatus, as set forth in claim 20, wherein said transport frame includes at least one upper beam extending in the elongated direction of the support member and located above the at least two parallel beams and diagonal members interconnecting said beams for forming a load carrying structure.

26. Apparatus, as set forth in claim 25, wherein said diagonal members form part of a support frame extending transversely of the support member and includes a horizontal beam connected with the lower elongated beams, and working platforms supported below said transverse beam.

27. Apparatus, as set forth in claim 26, wherein said working platforms are suspended by hangers from said transverse beam, and means for adjusting and fixing said hangers.

28. Apparatus, as set forth in claim 27, wherein said support frame includes a roof support and a roof covering positioned on said roof support.

* * * * *